United States Patent [19]

Martinez

[11] 4,020,738

[45] May 3, 1977

[54] RECEIVER FOR SPENT SHELLS

[76] Inventor: Javier A. Martinez, 7512 Cravell Ave., Pico Rivera, Calif. 90660

[22] Filed: Oct. 14, 1975

[21] Appl. No.: 622,021

[52] U.S. Cl. ..... 89/33 F; 42/1 T

[51] Int. Cl.[2] ..... F41C 27/00

[58] Field of Search ..... 89/33 F; 42/1 T

[56] References Cited

UNITED STATES PATENTS

| | | | |
|---|---|---|---|
| 663,262 | 12/1900 | Dieterich | 42/1 T X |
| 1,201,189 | 10/1916 | Johnson | 42/1 T X |
| 1,614,755 | 1/1927 | Neet | 42/1 T UX |
| 2,122,423 | 7/1938 | Joyce | 89/33 F |
| 2,354,277 | 7/1944 | Richardson | 89/33 F X |
| 2,779,243 | 1/1957 | Molins et al. | 89/33 F |
| 3,156,991 | 11/1964 | Adams | 89/33 F X |
| 3,771,248 | 11/1973 | Linehan | 42/1 T |

*Primary Examiner*—David H. Brown
*Attorney, Agent, or Firm*—Dominick Nardelli

[57] ABSTRACT

A receiver for spent sheels is disclosed wherein a rigid compartment is formed and includes a mounting means for mounting one end of the compartment adjacent to the shell ejection slot of a gun, and for supporting the rigid compartment away from the body of the hand gun so as not to interfere with the operation of the hand gun. Since the opening in the compartment is disposed in register with the ejection slot of the gun, the ejected shells enter the compartment. A trap door is disposed within the compartment near the opening so that spent shells do not jump out of the compartment, for example, as when the gun recoils or when it is laid down. For use on a pistol the mounting means consists of opposing rigid panels or flaps which are disposed on each side of the pistol grip. The panel near the compartment is affixed to the underside thereof, while the other panel is formed to extend up over the pistol and to be fixed to the upper side of the compartment. For use in a rifle, the mounting means consists of a relatively flexible sheet wrapped around the rifle and has means for attaching the opening of the compartment to the sheet so that it can register with the shell ejection slot of the rifle.

1 Claim, 5 Drawing Figures

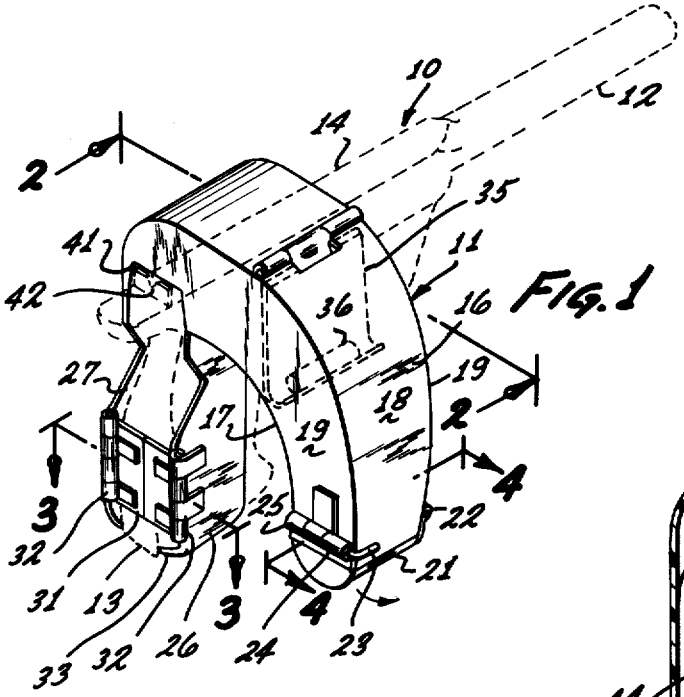
FIG. 1
FIG. 2
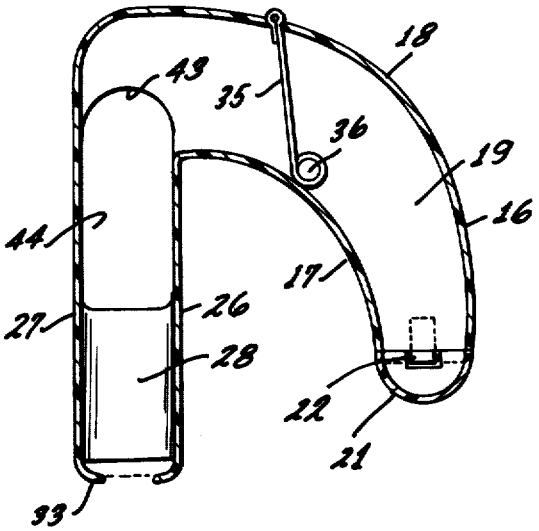
FIG. 3
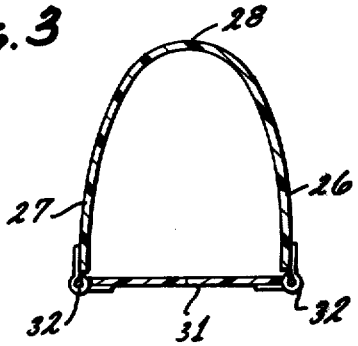
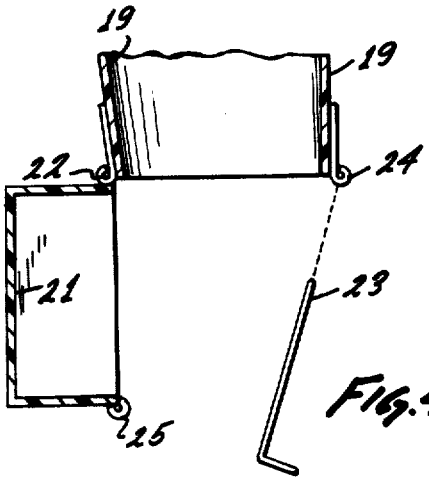
FIG. 4
FIG. 5
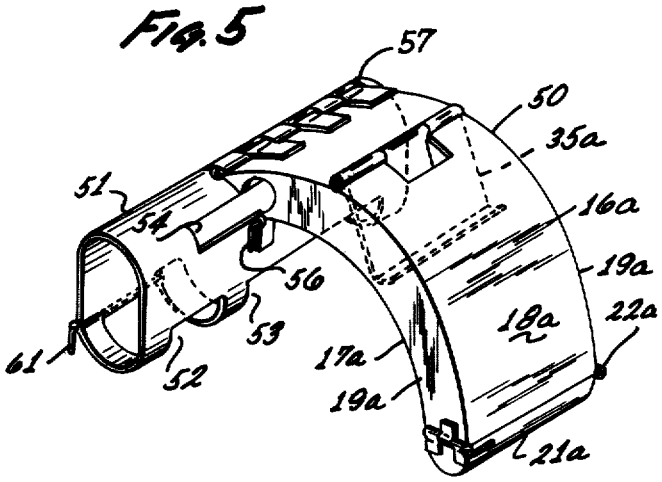

RECEIVER FOR SPENT SHELLS

FIELD OF THE INVENTION:

This invention relates, generally, to a receiver for accumulating empty or spent shells or cartridges as on firing or discharged from firearms.

BACKGROUND OF THE INVENTION

In the past, many types of receivers for spent or fired shells have been disclosed. The more effective receivers were the type that required modifications to the firearms in order to mount them thereon. Other types were such that they could only be used on the particular weapons. Therefore, if one wanted to use a receiver on another type of weapon, inventive know-how was required, as evidenced by U.S. Pat. Nos. 2,354,277; 3,153,891; 3,156,991; and 3,618,458.

OBJECTS OF THE INVENTION

An object of this invention is to provide a receiver for spent shells that is more versatile than prior art receivers.

Another object of this invention is to provide a spent shell receiver that can be mounted on a firearm without altering the firearm.

These and other objects and features of advantage will become more apparent after studying the following description of the preferred embodiments of my invention, together with the appended drawings.

BRIEF DESCRIPTION OF THE DRAWINGS

FIG. 1 is a pictorial view of one type of receiver as would be used on a pistol that is shown by dash-lines.

FIG. 2 is a section of the receiver shown in FIG. 1, taken on a plane containing the line 2—2 and in the direction of the arrows.

FIG. 3 is another section of the receiver shown in FIG. 1, taken on the plane contained in the line 3—3 and in the direction of the arrows.

FIG. 4 is another section of the receiver shown in FIG. 1, taken on a plane containing line 4—4 and oriented normal to the arrows.

FIG. 5 is a pictorial view of another type of spent shell receiver as would be used on, for example, a rifle.

DETAILED DESCRIPTION OF THE DRAWINGS:

Referring to FIG. 1, in particular, there is shown a standard pistol 10 in dash lines and my novel spent shell receiver 11 attached thereto. This pistol 10 has a barrel 12, a handle or grip 13, and a breech 14, with the necessary shall ejection slot (not shown, as it is hidden from view) to allow spent shells to be thrown out of the breech to the right of the operator.

The receiver 11 has a generally rectangular cross-section tube 16. The tube 16 has downwardly and outwardly curved bottom 17 (FIG. 2) and top 18, and two sides 19 formed integral with the top and bottom 17. The lower end of the tube 16 is fitted with a removable cover 21, conveniently held in place by a suitable means 22 which allows the cover 21 to swing downward, as shown in FIG. 4, by simply removing a pin 23 from respective eyelets 24 and 25 on one side 19 and cover 21. To the bottom 17 is attached a flap 26 while the top 18 is shaped to extend over the pistol to form another attachment flap 27. These flaps 26 and 27 would be disposed on opposite sides of the hand graip 13. To insure that the receiver 11 is attached to the pistol after the operator lays the weapon down, the front portion of the flaps 26 and 27 away from the operator, continue to form a bridging section 28 which would wrap over the front of the hand grip 13. Removably connected to the rear edges of flaps 26 and 27 is a securing plate 31 having suitable means 32 to removably fasten the plate 31 to both flaps 26 and 27. The flaps 26 and 27 each have an inward turning flange 33 on the bottom to hold the pistol steady with respect to the receiver 11. Within the tube 16, near its entrance, is disposed a door 35 which swings one way, and is held shut by a weight 36 fixed on the lower end. In order that the receiver 11 would not be in the operator's line of sight when he is aiming the pistol, both sides 19 each have cutouts. The side 19 near the operator has a cutout 41 which has a rectangular shape so as not to interfere with the rear site 42 on the pistol. The other side 19 has a simple cutout 43 which is, for example, arched.

To use the receiver, the plate 31 is disengaged from one or both flaps 26 and 27 so that it is out of the way. The muzzle of the pistol is passed through an opening 44 which is a continuation of cutout 43. Then the plate 31 is re-fastened. The operator performs his target practice and the spent shells, as they are ejected from the pistol, must enter the tube 16, forcing the door 35 to open, whereby the shells are collected on the cover 21. If the operator lays his weapon down while shells are in the receiver, the door 35 retains the shells; and if the operator cannot handle the recoil of the gun, the shells are prevented from escaping upward by the door 35.

Although the flaps 26 and 27 are shown with a bridging section 28, one skilled in the art could omit this bridging section 28 and also the plate 31, and secure the receiver by removing the standard non-metallic plates (not shown) which are located on opposite sides of the hand grip of the pistol. These non-metallic plates are reassembled with the respective flaps 26 and 27, sandwiched between each non-metallic plate, and the metallic grip. This can readily be done as the flaps need to be about 1/16th of an inch thick.

Referring to FIG. 5, a spent shell receiver 50 for a rifle type weapon is shown. As in the receiver 11, receiver 50 has a generally rectangular cross-section tube 16*a* which has a downward and outwardly curved bottom 17*a*, and a top 18*a*, and two sides 19*a* formed integral with the top 18*a* and bottom 17*a*. The lower end of the tube 16*a* is suited with a removable cover 21*a*, conveniently held in place by suitable means 22*a*. A swinging door 35*a* is also provided. The top 18*a* and bottom 17*a* are suitably fastened to a sleeve section 51 which wraps around the stock of a rifle (not shown). This sleeve section 51 has means 61 for fastening its edges together to form a tube. The underside of section 51 is made with cutouts; for example, cutout 52 could be for trigger guard clearance, and cutout 53 could be for magazine clearance. This section 51 also has still an ejector cutout 54, which extends under top 18*a* and which is placed over the ejection slot of the rifle so that the spent shells are capable of entering the tube 16*a*. The tube 16*a* has its opening adjacent to cutout 54 to register with a portion of the ejector cutout 54 which portion is hidden by the tube 16*a*. Convenient means 56 and 57 are used to attach the bottom 17*a* and top 18*a* to section 51.

Having described the preferred embodiments of my invention, one skilled in the art, after studying the above disclosure, could devise other embodiments without departing from the spirit or scope of my invention. Therefore, my invention is not to be considered as limited to the disclosed embodiments, but includes all embodiments falling within the scope of the appended claims.

I claim:

1. A shell receiving device for a pistol having a barrel and a handgrip, said device comprising;

a tube having a pair of side members, a top member and a bottom member;

said side members being made of sheet material and having an arch shape;

said top member being made of sheet material and bonded to both side members to have an exposed convex surface;

said bottom member being made of sheet material and bonded to both side members to have an exposed concave surface;

said top member being larger than said bottom so that at one end of said tube said top member extends a greater arc distance than said bottom member;

a first flap attached to said bottom member;

a second flap attached to said top member so that said first and second flaps are substantially in parallel relationship;

a bridging section attached to both said first and second flaps at their adjacent parallel edges so that a U-shaped member is formed;

a removeable plate removeably attached to at least one of said first and second flaps;

a cover closing the other end of said tube;

a door disposed within said tube nearer said one end then said other end and disposed to swing in one direction to allow shells to travel from said one end to said other end.

* * * * *